US009567531B2

(12) United States Patent
Fujiyama et al.

(10) Patent No.: US 9,567,531 B2
(45) Date of Patent: Feb. 14, 2017

(54) FLUID CATALYTIC CRACKING PROCESS, AND GASOLINE AND LIQUEFIED PETROLEUM GAS OBTAINED BY THE PROCESS

(75) Inventors: Yuichiro Fujiyama, Yokohama (JP); Toshiaki Okuhara, Yokohama (JP); Shigeko Okuhara, legal representative, Fujisawa (JP)

(73) Assignee: NIPPON OIL CORPORATION, Tokyo (JP)

( * ) Notice: Subject to any disclaimer, the term of this patent is extended or adjusted under 35 U.S.C. 154(b) by 946 days.

(21) Appl. No.: 12/575,503

(22) Filed: Oct. 8, 2009

(65) Prior Publication Data

US 2010/0089795 A1 Apr. 15, 2010

(30) Foreign Application Priority Data

Oct. 14, 2008 (JP) ..... 2008-265611

(51) Int. Cl.
*C10G 11/18* (2006.01)
*C10G 51/02* (2006.01)
(Continued)

(52) U.S. Cl.
CPC ..... *C10G 11/18* (2013.01); *C10G 51/026* (2013.01); *C10L 1/06* (2013.01); *C10L 3/12* (2013.01)

(58) Field of Classification Search
CPC ..... C10G 11/18; C10G 51/026; C10L 3/12; C10L 1/06
(Continued)

(56) References Cited

U.S. PATENT DOCUMENTS 4,242,237 A * 12/1980 Gladrow et al. ..... 208/120.1
4,585,545 A 4/1986 Yancey, Jr. et al.
(Continued)

FOREIGN PATENT DOCUMENTS

CN 1299403 6/2001
CN 1425055 6/2003
(Continued)

OTHER PUBLICATIONS

A. Corma et al., New Materials as FCC Active Matrix Components for Maximizing Diesel (Light Cycle Oil, LCO) and Minimizing its Aromatic Content, 127 CATAL. TODAY Mar. 16, 2007.*
(Continued)

*Primary Examiner* — Randy Boyer
*Assistant Examiner* — Juan Valencia
(74) *Attorney, Agent, or Firm* — Greenblum & Bernstein, P.L.C.

(57) ABSTRACT

The fluid catalytic cracking process according to the present invention includes a first step of feeding a feedstock to a first fluid catalytic cracker, and catalytically cracking the feedstock in the first fluid catalytic cracker, so as to produce a fraction (LCO) having a boiling range of 221 to 343° C. and having a total aromatic content of 40 to 80 volume %; and a second step of feeding an oil to be processed containing the fraction to a second fluid catalytic cracker having a reaction zone, a separation zone, a stripping zone, and a regeneration zone, and catalytically cracking the oil in the reaction zone of the second fluid catalytic cracker, in the presence of a cracking catalyst, at an outlet temperature of the reaction zone of 550 to 750° C., a contact time between the oil and the catalyst of 0.1 to 1 second, and a catalyst/oil ratio of 20 to 40 wt/wt.

4 Claims, 1 Drawing Sheet

(51) Int. Cl.
*C10L 1/06* (2006.01)
*C10L 3/12* (2006.01)

(58) Field of Classification Search
USPC ..... 208/113
See application file for complete search history.

(56) References Cited

U.S. PATENT DOCUMENTS

| | | | | |
|---|---|---|---|---|
| 4,663,025 | A * | 5/1987 | Fu | B01J 29/08 208/120.15 |
| 4,738,766 | A * | 4/1988 | Fischer et al. | 208/68 |
| 5,013,699 | A * | 5/1991 | Vassilakis | B01J 29/08 502/73 |
| 5,152,883 | A | 10/1992 | Melin et al. | |
| 5,773,676 | A | 6/1998 | Drake et al. | |
| 6,106,697 | A | 8/2000 | Swan et al. | 208/77 |
| 6,258,257 | B1 | 7/2001 | Swan, III et al. | 208/74 |
| 6,565,739 | B2 | 5/2003 | Winter | 208/77 |
| 6,569,316 | B2 | 5/2003 | Winter | |
| 2001/0052482 | A1 | 12/2001 | Winter | 208/67 |
| 2008/0138274 | A1* | 6/2008 | Garcia-Martinez | B01J 29/005 423/711 |

FOREIGN PATENT DOCUMENTS

| | | | |
|---|---|---|---|
| EP | 346007 | A1 * | 12/1989 |
| EP | 2 177 588 | | 4/2010 |
| JP | 61-148295 | | 7/1986 |
| JP | 10-046160 | | 2/1998 |
| JP | 10046160 | A * | 2/1998 |
| JP | 2003-531241 | | 10/2003 |
| JP | 2004-501223 | | 1/2004 |
| WO | 01/79394 | | 10/2001 |
| WO | 2008/026635 | | 3/2008 |

OTHER PUBLICATIONS

J. Ancheyta et al., "Results of processing VGO-LCO blends in a fluid catalytic cracking commercial unit", ENERGY AND FUELS, vol. 16, pp. 718-723, XP002563906, Sep. 3, 2002.
Extended European Search Report dated Jan. 28, 2010 that issued with respect to patent family member European Patent Application No. 09171103.6.
Office Action issued with respect to patent family member Japanese Patent Application No. 2008-265611, mailed Feb. 12, 2013.
Office Action from counterpart Application, CN Patent Application No. 200910177877.7 issued on Apr. 2, 2013.

* cited by examiner

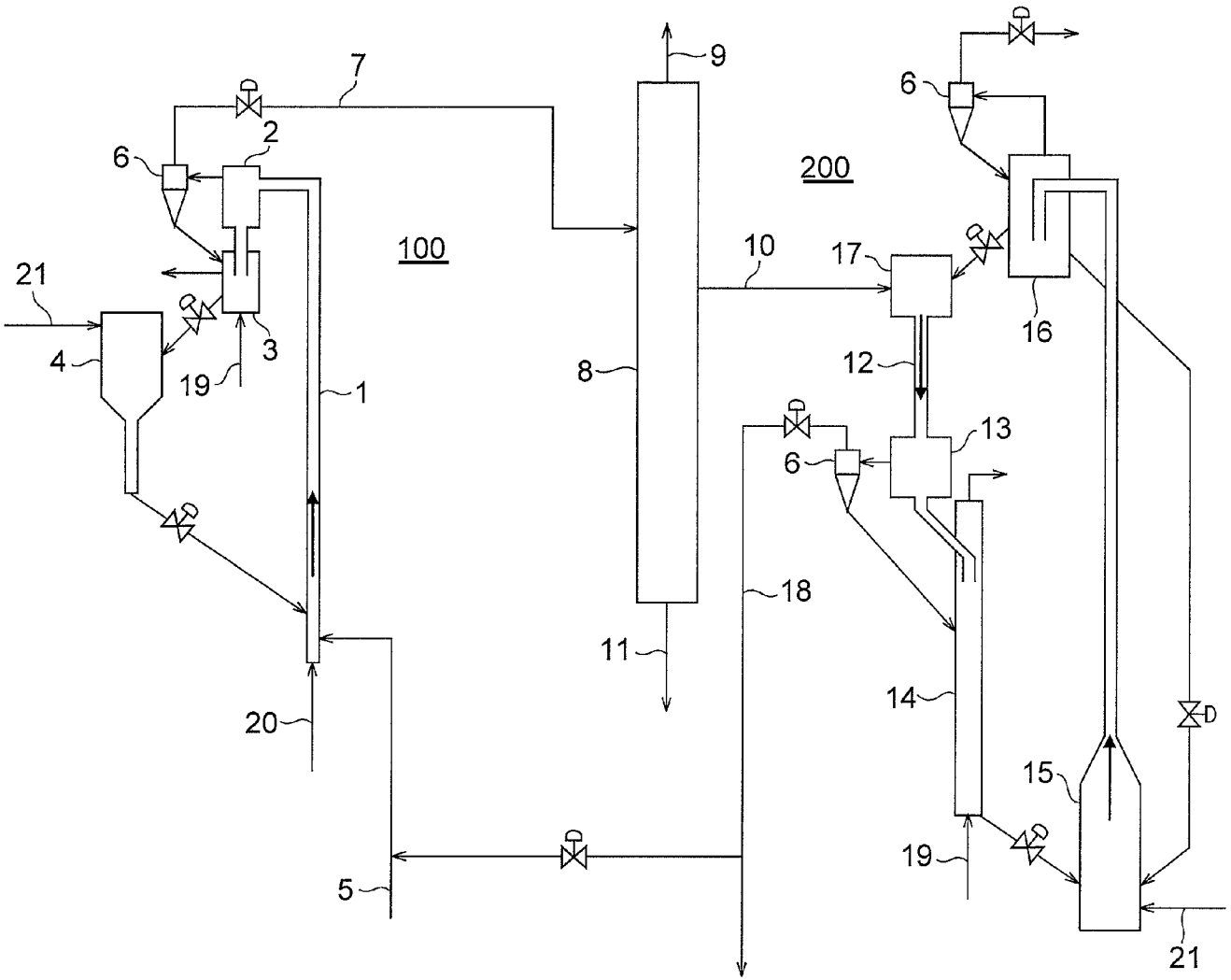
200
100
1
2
3
4
5
6
7
8
9
10
11
12
13
14
15
16
17
18
19
20
21

FLUID CATALYTIC CRACKING PROCESS, AND GASOLINE AND LIQUEFIED PETROLEUM GAS OBTAINED BY THE PROCESS

BACKGROUND OF THE INVENTION

Field of the Invention

The present invention relates to a fluid catalytic cracking process for heavy oils and the like, and to a gasoline and liquefied petroleum gas obtained by the process.

Related Background Art

Research is being conducted on techniques to convert heavy oils produced in crude oil refining processes to gasoline of higher value. For example, Japanese Patent Laid-Open No. 10-46160 (which will be referred to as "document 1" hereafter) discloses a fluid catalytic cracking process which includes a combination of general heavy oil fluid catalytic cracking with extremely severe heavy oil fluid catalytic cracking, in order to produce gasoline and light olefins from heavy oils in high yield.

SUMMARY OF THE INVENTION

More specifically, the invention disclosed in the above-mentioned document 1 relates to a process including feeding a heavy oil to a first fluid catalytic cracker, which performs general heavy oil fluid catalytic cracking, and subsequently feeding the resulting cracked product to a distillation tower for distillation. In this process, LCO (Light Cycle Oil) and/or $HCO^+$ (Heavy Cycle Oil) produced by the distillation are/is fed as a feedstock to a second fluid catalytic cracker, where the feedstock is subjected to catalytic cracking under extremely severe conditions (see paragraphs [0017] to [0019] of document 1).

LCO has a boiling range that overlaps with that of a gas oil fraction. Because of its high aromatic content, blending LCO into gas oils tends to reduce the cetane number of the gas oils. If it is possible to efficiently crack such LCO to produce fractions of higher value, LCO can be utilized as a feed for the production of gasoline and the like. The present inventors, however, found that even if LCO is subjected to catalytic cracking under extremely severe conditions, sufficiently efficient cracking of LCO is sometimes impossible. In this case, the amount of LCO produced by fluid catalytic cracking may increase.

The present invention has been accomplished in view of the above-mentioned problem. An object of the invention is to provide a fluid catalytic cracking process which allows efficient production of fractions of higher value from LCO, and allows the amount of LCO to decrease sufficiently.

The present inventors conducted research on the relationship between the composition and decomposition properties of LCO. Consequently, they found that feeding LCO having a total aromatic content within a predetermined range to a fluid catalytic cracker that performs catalytic cracking under extremely severe conditions is effective for converting the LCO to gasoline and the like, as well as reducing the amount of LCO. The present invention has been completed based on this finding.

That is, the fluid catalytic cracking process according to the present invention includes a first step of feeding a feedstock to a first fluid catalytic cracker having a reaction zone, a separation zone, a stripping zone, and a regeneration zone, and catalytically cracking the feedstock in the first fluid catalytic cracker, so as to produce a fraction having a boiling range of 221 to 343° C. and having a total aromatic content of 40 to 80 volume %; and a second step of feeding an oil to be processed containing the fraction to a second fluid catalytic cracker having a reaction zone, a separation zone, a stripping zone, and a regeneration zone, and catalytically cracking the oil in the reaction zone of the second fluid catalytic cracker, in the presence of a cracking catalyst, at a reaction zone outlet temperature of 550 to 750° C., a contact time between the oil and the catalyst of 0.1 to 1 second, and a catalyst/oil ratio of 20 to 40 wt/wt.

In the fluid catalytic cracking process of the present invention, LCO having a total aromatic content of 40 to 80 volume % can be produced through the first step. By feeding the oil to be processed containing this LCO to the second fluid catalytic cracker, and catalytically cracking the oil under extremely severe conditions, fractions of higher value such as gasoline and the like can be efficiently produced from the LCO.

The term "LCO" as used herein means a fraction having a boiling range of 221 to 343° C. produced by fluid catalytic cracking (FCC). The phrase "total aromatic content" means the percent by volume (volume %) of the contents of various aromatics as measured according to the method described in JPI-5S-49-97: "Determination of Hydrocarbon Types-High Performance Liquid Chromatography" of the Journal of the Japan Petroleum Institute, published by the Japan Petroleum Institute. The term "boiling range" means the values as measured according to the method described in JIS K 2254: "Petroleum Products-Determination of Distillation Characteristics".

The fluid catalytic cracking process according to the present invention may further include a step of passing a cracked product produced through the second step back into the first fluid catalytic cracker. By passing the cracked product produced through the second step back into the first fluid catalytic cracker for recycling, the yields of fractions of higher value such as gasoline are further improved. Since the content of the fraction corresponding to LCO is sufficiently reduced in the cracked product produced through the second step, the accumulation of any hardly reactive component contained in that fraction in the system can be sufficiently prevented, even if the above-described recycling is performed.

The fraction (LCO) produced through the first step preferably has a density at 15° C. of less than 0.95 g/cm$^3$. When the oil to be processed contains LCO with a density of less than 0.95 g/cm$^3$, gasoline can be produced in an even higher yield. The term "density" as used herein means the value as measured according to JIS K 2249: "Crude Petroleum and Petroleum Products-Determination of Density and Petroleum Measurement Tables Based on a Reference Temperature (15° C.)".

According to the fluid catalytic cracking process of the present invention, various fuel and petrochemical products containing the cracked product produced through the first and second steps can be provided. That is, the present invention provides a gasoline containing a portion or all of a fraction having a boiling range of 25 to 220° C. produced by the fluid catalytic cracking process of the present invention, or a hydrotreated fraction thereof. Moreover, the present invention provides a liquefied petroleum gas containing hydrocarbons with 3 or 4 carbon atoms produced by the fluid catalytic cracking process of the present invention.

According to the present invention, fractions of higher value can be efficiently produced from LCO, and the amount of LCO can be sufficiently reduced.

BRIEF DESCRIPTION OF THE DRAWING

FIG. 1 is a flow chart of a fluid catalytic cracking process according to one embodiment of the present invention.

DESCRIPTION OF THE PREFERRED EMBODIMENTS

Preferred embodiments of the present invention will be described below. FIG. 1 is a flow chart of a fluid catalytic cracking process of one embodiment.

<First Step>

In the fluid catalytic cracking process of this embodiment, a feedstock 5 is first fed into a first fluid catalytic cracker 100, where the feedstock 5 is subjected to fluid catalytic cracking (first step). The phrase "fluid catalytic cracking" means that a heavy feedstock is contacted with a catalyst being held in a fluid state, and thereby cracked to light hydrocarbons principally including gasoline and light olefins. In the first step, LCO having a total aromatic content of 40 to 80 volume % is produced.

The LCO produced through the first step has a total aromatic content of 40 to 80 volume %, as mentioned above. The total aromatic content of the LCO is more preferably 40 to 70 volume %, and still more preferably 40 to 65 volume %. If the total aromatic content is less than 40 volume %, the amount of the aromatics to be cracked will become insufficient when the LCO is fed to a second fluid catalytic cracker 200, resulting in an insufficient research octane number of gasoline. Conversely, if the total aromatic content is more than 80 volume %, the coke yield will increase in the second step described below, which increases the amount of LCO that is not cracked.

The LCO produced through the first step preferably has a density at 15° C. of less than 0.95 g/cm$^3$. If the LCO density exceeds 0.95 g/cm$^3$, the coke yield will increase in the second step, which often increases the amount of LCO that is not cracked. Moreover, the catalytic activity will deteriorate due to the increased coke yield; therefore, thermal cracking will proceed relatively further, which often increases the amount of light gases. The LCO density is more preferably less than 0.94 g/cm$^3$. The lower limit of the LCO density is preferably 0.88 g/cm$^3$, and more preferably 0.89 g/cm$^3$. If the LCO density is less than 0.88 g/cm$^3$, the research octane number of the gasoline produced in the second step will become insufficient.

In order to produce LCO that meets the above-described requirements in the first fluid catalytic cracker 100, the feedstock composition, the catalyst composition, the outlet temperature of a reaction zone 1, the contact time between the feedstock and catalyst, the catalyst/oil ratio, and the like, may be suitably adjusted. The type of the feedstock, the fluid catalytic cracker 100, the catalyst, and the like will be described below.

The feedstock 5 to be fed to the first fluid catalytic cracker 100 is preferably a feedstock containing a heavy oil produced by distillation of a crude oil. Examples of such heavy oils include atmospheric residue, vacuum gas oils produced by further distilling atmospheric residue under vacuum, vacuum residue, hydrotreated oils or thermally cracked oils thereof, and mixed oils thereof.

The first fluid catalytic cracker is not particularly limited as long as it has a reaction zone 1, a separation zone 2, a stripping zone 3, and a regeneration zone 4. The reaction zone 1 may be either a downflow reactor in which both the catalyst particles and feedstock pass through the tube downward, or an upflow reactor in which both the catalyst particles and feedstock pass through the tube upward; but a downflow reactor is preferably used.

The catalytic cracking catalyst used in the first fluid catalytic cracker 100 is preferably a catalyst containing 10 to 50 mass %, and more preferably 15 to 40 mass %, of an ultrastable Y-type zeolite. The ultrastable Y-type zeolite used preferably has a Si/Al atomic ratio of 3 to 20. The Si/Al atomic ratio is more preferably 5 to 20, and still more preferably 7 to 15. If the Si/Al atomic ratio is less than 3, the catalytic activity will be excessively high, which often increases the amount of gases produced. Conversely, if the Si/Al atomic ratio exceeds 20, the zeolite cost will increase, which is economically undesirable.

Moreover, the ultrastable Y-type zeolite used preferably has a crystal lattice constant of 24.55 Å or less, and a degree of crystallization of 90% or more. Further, the ultrastable Y-type zeolite used is preferably an ultrastable Y-type zeolite obtained by introducing an alkali rare earth metal to ion exchange sites thereof.

Examples of preferred embodiments of the catalyst include a catalyst obtained by forming an ultrastable Y-type zeolite into particles using a binder, together with a matrix which is a sub-active component and capable of cracking large molecules of a heavy oil, and a filler such as kaoline. Silica alumina is preferably used as the matrix component used in the catalyst.

In addition to the ultrastable Y-type zeolite, the catalyst may further contain a crystalline aluminosilicate zeolite, a silicoaluminophosphate (SAPO), or the like having a pore size smaller than that of the Y-type zeolite. Examples of such zeolites include ZSM-5, and examples of SAPOs include SAPO-5, SAPO-11, and SAPO-34. These zeolites or SAPOs may be contained in the same catalyst particles as the catalyst particles containing the ultrastable Y-type zeolite, or may be contained in separate catalyst particles.

The outlet temperature of the reaction zone 1 in the first fluid catalytic cracker 100 is preferably 450 to 550° C., and more preferably 480 to 530° C. If the outlet temperature of the reaction zone 1 is less than 450° C., the total aromatic content of the LCO produced in the first step will often become insufficient. Conversely, if the outlet temperature exceeds 550° C., thermal cracking will be significant, which often increases the amount of dry gases. The phrase "outlet temperature of the reaction zone 1" refers to the outlet temperature of the reactor, which is the temperature prior to rapid cooling of the cracked product, or the separation of the cracked product from the catalyst.

The contact time between the feedstock and the catalyst in the first fluid catalytic cracker 100 is preferably 1.5 to 10 seconds, and more preferably 2 to 8 seconds. If the contact time is less than 1.5 seconds, cracking of the feedstock will often become insufficient. Conversely, if the contact time exceeds 10 seconds, the amounts of propylene, gasoline, and the like will decrease due to excessive cracking or hydrogen transfer reactions, which often increases the amount of light gases and the coke yield. The phrase "contact time between the feedstock and the catalyst" means the time required from the time when the feedstock is contacted with the catalyst at the inlet of the fluidized-bed reactor to the time when the reaction product is separated from the catalyst at the reactor outlet. The phrase "hydrogen transfer reactions" means reactions in which olefins receive hydrogen from naphthene and the like to be converted to paraffins. These reactions cause the amount of light olefins to decrease, or the research octane number of gasoline to decrease, for example.

The catalyst/oil ratio in the first fluid catalytic cracker 100 is preferably 4 to 10 wt/wt. If the catalyst/oil ratio is less than 4 wt/wt, cracking of the feedstock 5 will often become insufficient. Conversely, if the catalyst/oil ratio exceeds 10 wt/wt, the catalyst circulation rate will become high, making it impossible to ensure a catalyst residence time necessary for catalyst regeneration in the regeneration zone, often resulting in insufficient catalyst regeneration. The phrase "catalyst/oil ratio" means the ratio of the catalyst circulation rate (ton/h) relative to the feed rate of the feedstock (ton/h).

The reaction pressure in the first fluid catalytic cracker 100 is preferably 0.1 to 0.3 MPa, and more preferably 0.12 to 2.0 MPa. If the reaction pressure is less than 0.1 MPa, the difference between the reaction pressure and atmospheric pressure will become too small, often making it difficult to adjust the pressure through a control valve. If the reaction pressure is less than 0.1 MPa, the pressure of the regeneration zone 4 will also become low, so that the size of the vessel must be increased in order to ensure a gas residence time necessary for regeneration, which is economically undesirable. Conversely, if the reaction pressure exceeds 0.3 MPa, the ratio of bimolecular reactions, such as hydrogen transfer reactions, relative to the cracking reaction, which is a unimolecular reaction, will often increase. The term "reaction pressure" means the total pressure in the fluidized bed reactor.

The mixture of the cracked product after the catalytic cracking treatment in the reaction zone 1, unreacted materials, and the catalyst, is sent to the separation zone 2 together with a lift gas 20, and the catalyst is separated from the mixture in the separation zone 2. A solid-liquid separator utilizing centrifugal force, such as a cyclone, is preferably used as the separation zone 2. The catalyst separated in the separation zone 2 is sent to the stripping zone 3. This catalyst is contacted with a stripping steam 19 in the stripping zone 3, so that the catalyst particles are stripped of a majority of hydrocarbons such as the product and unreacted materials. During the reaction, a portion of the feed forms a heavier carbonaceous material (coke) and deposits on the catalyst; however, the catalyst containing deposited coke or additionally heavy hydrocarbons is sent to the regeneration zone 4 (regeneration tower) from the stripping zone 3. On the other hand, the cracked product separated in the separation zone 2 is sent to a secondary separator 6. In the secondary separator 6, remaining catalyst particles are removed from the cracked product, thereby yielding a cracked product 7.

In the regeneration zone 4, the catalyst introduced from the stripping zone 3 is contacted with catalyst regeneration air 21, and preferably treated under the following conditions: the temperature of the catalyst dense phase: 650 to 800° C.; the pressure in the regeneration zone 4: 0.1 to 0.3 MPa; the oxygen concentration in the exhaust gas at the outlet of the regeneration zone 4: 0 to 3 mol %.

As described above, the temperature of the catalyst dense phase in the regeneration zone 4 is preferably 650 to 800° C., and more preferably 670 to 750° C. If the temperature of the catalyst dense phase in the regeneration zone 4 is less than 650° C., coke combustion will become insufficient. Conversely, if the temperature of the catalyst dense phase in the regeneration zone 4 exceeds 800° C., catalyst deterioration will be accelerated. Moreover, it will be necessary to use an expensive member that can withstand the temperature of the catalyst dense phase in the regeneration zone 4 as a material of the regeneration zone 4, which is economically undesirable.

As described above, the pressure in the regeneration zone 4 is preferably 0.1 to 0.3 MPa. If the pressure in the regeneration zone 4 is less than 0.1 MPa, the size of the vessel of the regeneration zone 4 will be increased, in order to ensure a gas residence time necessary for regeneration, which is economically undesirable. Conversely, if the pressure in the regeneration zone 4 exceeds 0.3 MPa, the pressure in the reaction zone 4 will also increase. This causes reactions such as hydrogen transfer reactions in the reaction zone 1, which is economically undesirable.

As described above, the oxygen concentration in the exhaust gas at the outlet of the regeneration zone 4 is preferably 0 to 3 mol %. If the oxygen concentration exceeds 3 mol %, excess air is being sent into the regeneration zone 4 using excess power, which is economically undesirable. The catalyst that has undergone an oxidation treatment is the regenerated catalyst. This regenerated catalyst is a catalyst in which the amount of the coke and heavy hydrocarbons deposited thereon has been reduced by combustion. The regenerated catalyst is continuously circulated through the reaction zone 1. In some cases, the cracked product is rapidly cooled immediately before or after the separation zone 2, in order to prevent unnecessary thermal cracking or excessive cracking. The catalyst is heated by the quantity of heat generated upon the combustion of the carbonaceous material in the regeneration zone 4, and the heat is carried into the reaction zone 1 together with the catalyst. The feedstock 5 is heated and vaporized by this quantity of heat. Moreover, since the cracking reaction is an endothermic reaction, this quantity of heat is also utilized as the heat for the cracking reaction.

Preferably, the first fluid catalytic cracker 100 further includes a collection zone for the cracked product 7. One example of the collection zone for the cracked product 7 is a cracked product collection facility which collects the cracking product 7 by separation based on boiling points or the like. The cracked product collection facility may be constituted by a fractionating tower 8, with an absorption tower, a compressor, a stripper, a heat exchanger, or the like. LCO 10 can be collected by the cracked product collection facility. Additionally, HCO11 and LPG+naphtha 9 can be collected.

<Second Step>

The LCO (the oil to be processed) 10 produced through the first step is fed to a mixing zone 17 of the second fluid catalytic cracker 200, where the LCO 10 is contacted with the cracking catalyst and subjected to fluid catalytic cracking (second step). A fluid catalytic cracker having the same configuration as that of the first fluid catalytic cracker 100 can be used as the second fluid catalytic cracker 200. Similarly, a catalytic cracking catalyst containing an ultra-stable Y-type zeolite as in the first step, for example, can be used as the catalytic cracking catalyst. The oil to be processed is catalytically cracked in a reaction zone 12 of the second fluid catalytic cracker 200, in the presence of a cracking catalyst, at an outlet temperature of the reaction zone 12 of 550 to 750° C., a contact time between the oil and the catalyst of 0.1 to 1 second, and a catalyst/oil ratio of 20 to 40 wt/wt.

As described above, the outlet temperature of the reaction zone 12 in the second fluid catalytic cracker 200 is preferably 550 to 750° C., more preferably 550 to 650° C., and still more preferably 560 to 640° C. If the outlet temperature of the reaction zone 12 is less than 550° C., the yield of gasoline or liquefied petroleum gases will often become insufficient. Conversely, if the outlet temperature exceeds 750° C., thermal cracking will be significant, which often increases the amount of dry gases.

The cracked product produced by catalytic cracking is separated from the cracking catalyst at a separation zone 13. The catalyst separated by the separation zone 13 is sent to a stripping zone 14, where it is contacted with a stripping steam 19. In this way, the catalyst particles are stripped of a majority of hydrocarbons such as the product and unreacted materials. During the reaction, a portion of the feed forms a heavier carbonaceous material (coke) and deposits on the catalyst. This catalyst containing deposited coke or additionally heavy hydrocarbons is sent to a regeneration zone 15 (regeneration tower) from the stripping zone 14. On the other hand, the cracked product separated in the separation zone 13 is sent to a secondary separator 6. In the secondary separator 6, remaining catalyst particles are removed from the cracked product, thereby yielding a cracked product 18.

As described above, the contact time between the feedstock and the catalyst in the second fluid catalytic cracker 200 is 0.1 to 1.0 second, and preferably 0.3 to 0.9 seconds. If the contact time is less than 0.1 seconds, cracking of the LCO will often become insufficient. Conversely, if the contact time exceeds 1.0 second, the yields of propylene, gasoline, and the like will often decrease due to excessive cracking or hydrogen transfer reactions.

The catalyst/oil ratio in the second fluid catalytic cracker 200 is 20 to 40 wt/wt, and preferably 25 to 35 wt/wt. If the catalyst/oil ratio is less than 20 wt/wt, cracking of the LCO will often become insufficient. Conversely, if the catalyst/oil ratio exceeds 40 wt/wt, the catalyst circulation rate will become high, making it impossible to ensure a catalyst residence time necessary for catalyst regeneration in the regeneration zone 15, often resulting in insufficient catalyst regeneration.

The reaction pressure in the second fluid catalytic cracker 200 is preferably 0.1 to 0.3 MPa, and more preferably 0.12 to 2.0 MPa. If the reaction pressure is less than 0.1 MPa, the difference between the reaction pressure and atmospheric pressure will become too small, often making it difficult to adjust the pressure through a control valve. If the reaction pressure is less than 0.1 MPa, the pressure in the regeneration zone 15 will also become low, so that the size of the vessel must be increased in order to ensure a gas residence time necessary for regeneration, which is economically undesirable. Conversely, if the reaction pressure exceeds 0.3 MPa, the ratio of bimolecular reactions, such as hydrogen transfer reactions, relative to the cracking reaction, which is a unimolecular reaction, will often increase.

In the regeneration zone 15 of the second fluid catalytic cracker 200, the catalyst introduced from the stripping zone 14 can be contacted with catalyst regeneration air 21 and processed under the same conditions as those in the first fluid catalytic cracker 100. The regenerated catalyst is sent to a catalyst storage tank 16. Gases sent to the catalyst storage tank 16 together with the catalyst are separated at the secondary separator 6. The regenerated catalyst is introduced into the mixing zone 17 from the catalyst storage tank 16, and contacted with the LCO 10 again.

As with the first fluid catalytic cracker 100, the second fluid catalytic cracker 200 preferably further includes a collection zone for the cracked product. Fractions having predetermined boiling ranges (e.g., LCO) can be collected by the cracked product collection facility.

As described above, according to the fluid catalytic cracking process of this embodiment, the LCO having a total aromatic content of 40 to 80 volume % is fed to the second fluid catalytic cracker 200, where the oil to be processed is catalytically cracked under extremely severe conditions, thereby allowing efficient production of fractions of higher value from the LCO. Thus, the amount of LCO produced in the fluid catalytic cracking process can be sufficiently reduced.

The fluid catalytic cracking process according to this embodiment may further include the step of passing the cracked product 18 produced through the second step back into the first fluid catalytic cracker 100. By passing the cracked product back into the first fluid catalytic cracker for recycling, the yields of fractions of higher value can be further improved throughout the process. Since the fraction corresponding to LCO contained in the feedstock can be sufficiently reduced through the first and second steps, the accumulation of any hardly reactive component contained in that fraction in the system can be sufficiently prevented, even if the above-described recycling is performed.

A fraction having a boiling point of 25 to 220° C. produced by the first step and/or the second step can also be used as a gasoline base. A portion or all of the fraction having a boiling point of 25 to 220° C. may be used as a gasoline base. Moreover, the fraction having a boiling point of 25 to 220° C. can be hydrotreated, and the resulting hydrotreated fraction can be used as a gasoline base.

Furthermore, hydrocarbons with 3 or 4 carbon atoms produced by the first step and/or second step can be used as a liquefied petroleum gas base.

EXAMPLES

The present invention will be described in greater detail below based on Examples and Comparative Examples; however, the invention is by no means limited to the following Examples.

Example 1

A desulfurized atmospheric residue was fed to a first fluid catalytic cracker and subjected to first-stage fluid catalytic cracking (first step). Table 1 shows the properties of the desulfurized atmospheric residue used as a feedstock.

In Example 1, a pilot plant (manufactured by Xytel) having a reaction zone (adiabatic downflow reactor), a separation zone, a stripping zone, and a regeneration zone was used as the first fluid catalytic cracker. A catalyst prepared in the following manner was used as a catalytic cracking catalyst.

21,550 g of a dilution of JIS No. 3 water glass ($SiO_2$ concentration=11.6%) was added dropwise to 3,370 g of 40% sulfuric acid to give a silica sol with pH 3.0. 3,000 g of a stable Y-type zeolite (manufactured by Tosoh Corporation; HSZ-370HUA) and 4,000 g of kaolin were added to the entire amount of the silica sol and kneaded, after which the kneaded product was spray-dried with 250° C. hot air. The spray-dried product was washed with 0.2% ammonium sulfate at 50° C., and subsequently dried in an oven at 110° C. The dried product was further calcined at 600° C. to give a catalyst. The catalyst contained 30% of the ultrastable Y-type zeolite. The catalyst particles at this time had a bulk density of 0.7 g/ml, an average particle size of 71 μm, a surface area of 180 $m^2/g$, and a pore volume of 0.12 ml/g.

The thus-obtained catalyst was pseudo-equilibrated by being treated with 100% steam at 800° C. for 6 hours, before it is fed to the above-mentioned plant. The reaction conditions for fluid catalytic cracking were adjusted as follows.

(First Step)

The reaction-zone outlet temperature: 525° C.

The contact time: 2.0 seconds

The catalyst/feedstock ratio: 5.8 wt/wt

The temperature of the catalyst dense phase in the regeneration zone: 700° C.

LCO produced by the fluid catalytic cracking in the first fluid catalytic cracker was fed to a second fluid catalytic cracker and subjected to second-stage fluid catalytic cracking (second step). The reaction conditions for fluid catalytic cracking were adjusted as follows. The same type of catalyst as that in the first step was used.

(Second Step)

The reaction-zone outlet temperature: 600° C.

The contact time: 0.4 seconds

The catalyst/feedstock ratio: 30 wt/wt

The temperature of the catalyst dense phase in the regeneration zone: 680° C.

Table 2 shows the density and the total aromatic content of the LCO used as the oil to be treated, as well as the LCO conversion and the yields of cracked products in the second fluid catalytic cracker. In Table 2, the yield of each cracked product is represented by the mass ratio in percentage of the cracked product relative to the feedstock. C1 denotes methane gas, C2 denotes ethane gas, C3 denotes hydrocarbons with 3 carbon atoms, C4 denotes hydrocarbons with 4 carbon atoms, gasoline denotes hydrocarbons with 5 or more carbon atoms having a boiling point less than 221° C., LCO denotes a fraction having a boiling range of 221 to 343° C., and CLO denotes a fraction having a boiling point over 343° C. (clarified oil).

Example 2

A desulfurized vacuum gas oil was fed to a first fluid catalytic cracker and subjected to first-stage fluid catalytic cracking (first step). Table 1 shows the properties of the desulfurized gas oil used as a feedstock. LCO produced by the fluid catalytic cracking in the first fluid catalytic cracker was fed to a second fluid catalytic cracker and subjected to second fluid catalytic cracking (second step).

The first- and second-stage fluid catalytic cracking was conducted in the same manner as Example 1, except that the desulfurized vacuum gas oil was used as the feedstock, and the reaction conditions for fluid catalytic cracking were adjusted as follows.

(First Step)

The reaction-zone outlet temperature: 510° C.

The contact time: 2.0 seconds

The catalyst/feedstock ratio: 5.2 wt/wt

The temperature of the catalyst dense phase in the regeneration zone: 695° C.

(Second Step)

The reaction-zone outlet temperature: 600° C.

The contact time: 0.4 seconds

The catalyst/feedstock ratio: 30 wt/wt

The temperature of the catalyst dense phase in the regeneration zone: 680° C.

Comparative Example 1

A desulfurized atmospheric residue (see Table 1) was fed to a first fluid catalytic cracker and subjected to first-stage fluid catalytic cracking (first step). LCO produced by the fluid catalytic cracking in the first fluid catalytic cracker was fed to a second fluid catalytic cracker and subjected to second fluid catalytic cracking (second step).

The first- and second-stage fluid catalytic cracking was conducted in the same manner as Example 1, except that the reaction conditions for fluid catalytic cracking were adjusted as follows.

(First Step)

The reaction-zone outlet temperature: 600° C.

The contact time: 0.4 seconds

The temperature of the catalyst dense phase in the regeneration zone: 680° C.

The catalyst/feedstock ratio: 30 wt/wt (Second Step)

The reaction-zone outlet temperature: 600° C.

The contact time: 0.4 seconds

The temperature of the catalyst dense phase in the regeneration zone: 680° C.

The catalyst/feedstock ratio: 30 wt/wt

TABLE 1

| | | Desulfurized atmospheric residue | Desulfurized vacuum gas oil |
|---|---|---|---|
| Density at 15° C. (g/cm$^3$) | | 0.923 | 0.897 |
| Carbon residue (mass %) | | 3.94 | 0.2 |
| Sulfur content (mass %) | | 0.28 | 0.13 |
| Nitrogen content (mass %) | | 0.07 | 0.04 |
| Distillation characteristics (° C.) | Initial boiling point | 363 | 346 |
| | 10%-OFF | 415 | 401 |
| | 30%-OFF | 466 | 433 |
| | 50%-OFF | 524 | 463 |
| | 70%-OFF | — | 501 |
| | 90%-OFF | — | 557 |
| | End point | — | 627 |

TABLE 2

| | | | Ex. 1 | Ex. 2 | Comp. Ex. 1 |
|---|---|---|---|---|---|
| LCO produced through first step | Aromatic content (volume %) | Total aromatics | 64.2 | 61.1 | 82.0 |
| | | Monocyclic aromatics | 21.2 | 22.3 | 19.2 |
| | | Bicyclic aromatics | 36.7 | 32.7 | 55.2 |
| | | Tricyclic or higher polycyclic aromatics | 6.3 | 6.1 | 7.6 |
| | Density at 15° C. (g/cm$^3$) | | 0.9381 | 0.9171 | 0.9527 |
| | Conversion (mass %) | | 82.5 | 78.0 | 87.1 |
| Yield (mass %) | Dry gases ($H_2$, C1, C2) | | 2.5 | 1.4 | 6.3 |
| | LPG (C3, C4) | | 16.8 | 16.4 | 38.9 |
| | Propylene (C3) | | 5.3 | 5.2 | 18.4 |
| | Gasoline | | 56.5 | 56.1 | 29.8 |
| | LCO | | 7.6 | 8.0 | 8.3 |
| | CLO | | 9.9 | 14.0 | 4.6 |
| | Coke | | 6.7 | 4.1 | 12.1 |

What is claimed is:

1. A fluid catalytic cracking process comprising:

feeding a feedstock for a first cracking to a first fluid catalytic cracker having a reaction zone, a separation zone, a stripping zone, and a regeneration zone;

catalytically cracking the feedstock in the first fluid catalytic cracker in the presence of a cracking catalyst containing an ultrastable Y-type zeolite having a Si/Al ratio of 7 to 15 under reaction conditions to produce a cracked product;

collecting a fraction having a boiling range of 221 to 343° C., a density at 15° C. less than 0.95 g/cm$^3$, and a total aromatic content of 40 to 70 volume % from the cracked product;

feeding the fraction for a second cracking to a second fluid catalytic cracker having a reaction zone, a separation zone, a stripping zone, and a regeneration zone;

and catalytically cracking the fraction in the reaction zone of the second fluid catalytic cracker, in the presence of a cracking catalyst, at a reaction zone outlet temperature of 550 to 650° C., a contact time between the oil and the catalyst of 0.1 to 1 second, and a catalyst/oil ratio of 20 to 40 wt/wt.

2. The fluid catalytic cracking process according to claim 1, further comprising passing a cracked product produced through the second cracking back into the first fluid catalytic cracker.

3. The fluid catalytic cracking process according to claim 1, wherein the fraction from the first cracking has a polycyclic aromatics content of 43 volume % or less.

4. The fluid catalytic cracking process according to claim 2, wherein the fraction from the first cracking has a polycyclic aromatics content of 43 volume % or less.

* * * * *